US009835026B2

(12) United States Patent
Yu

(10) Patent No.: US 9,835,026 B2
(45) Date of Patent: Dec. 5, 2017

(54) HIGH-SPEED TRANSMISSION OF ANNULUS PRESSURE-WHILE-DRILLING BY DATA COMPRESSION

(71) Applicant: Schlumberger Technology Corporation, Sugar Land, TX (US)

(72) Inventor: Bo Yu, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/867,125

(22) Filed: Sep. 28, 2015

(65) Prior Publication Data

US 2017/0089195 A1 Mar. 30, 2017

(51) Int. Cl.
*E21B 47/18* (2012.01)

(52) U.S. Cl.
CPC ..... *E21B 47/18* (2013.01)

(58) Field of Classification Search
CPC ..... E21B 21/08; E21B 49/00; E21B 47/06; E21B 47/12; E21B 47/124
USPC ..... 340/853.1, 854.3, 854; 367/81–85
See application file for complete search history.

(56) References Cited

U.S. PATENT DOCUMENTS 4,628,495 A * 12/1986 Peppers ..... E21B 47/18 175/40
4,715,002 A 12/1987 Vernon et al.
5,168,932 A * 12/1992 Worrall ..... E21B 21/001 166/336
6,220,087 B1 4/2001 Hache et al.
6,446,014 B1 * 9/2002 Ocondi ..... E21B 43/006 702/12
2002/0074127 A1 6/2002 Birckhead et al.
2005/0016770 A1 1/2005 Mayes
2007/0198192 A1 * 8/2007 Hsu ..... E21B 47/12 702/6
2011/0203845 A1 * 8/2011 Jamison ..... E21B 44/02 175/40
2012/0285744 A1 * 11/2012 Bernard ..... E21B 21/08 175/57

(Continued)

OTHER PUBLICATIONS

International Search Report and Written Opinion issued in corresponding International application PCT/US2016/050604 on Nov. 28, 2016. 9 pages.

*Primary Examiner* — Ojiako Nwugo

(57) ABSTRACT

A method for transmitting data from a downhole tool to a surface location includes running a downhole tool into a wellbore. The downhole tool includes a pressure sensor. An annulus pressure in the wellbore is measured at a first time, using the pressure sensor, to produce a first pressure measurement. The first pressure measurement is compressed to produce a reference sample. The reference sample is transmitted to the surface location. The annulus pressure in the wellbore is measured at a second time, using the pressure sensor, to produce a second pressure measurement. A difference between the first pressure measurement and the second pressure measurement is determined to produce a first delta pressure measurement. The first delta pressure measurement is compressed to produce a first compressed delta pressure measurement. The first compressed delta pressure measurement is transmitted to the surface location.

10 Claims, 8 Drawing Sheets

(56) References Cited

U.S. PATENT DOCUMENTS

| | | | | |
|---|---|---|---|---|
| 2013/0093597 | A1* | 4/2013 | Stolpman | G01V 3/38 340/854.3 |
| 2013/0135114 | A1 | 5/2013 | Ringer et al. | |
| 2015/0176395 | A1* | 6/2015 | McCoy | E21B 47/0007 702/6 |
| 2015/0330168 | A1* | 11/2015 | Sun | E21B 47/06 700/282 |
| 2015/0345239 | A1* | 12/2015 | Samuel | G05B 15/02 700/282 |
| 2015/0377019 | A1* | 12/2015 | Gleitman | E21B 49/006 166/250.01 |
| 2016/0138350 | A1* | 5/2016 | Havre | E21B 21/062 175/25 |
| 2016/0245078 | A1* | 8/2016 | Mahmoud | E21B 47/18 |

* cited by examiner

HIGH-SPEED TRANSMISSION OF ANNULUS PRESSURE-WHILE-DRILLING BY DATA COMPRESSION

FIELD

Embodiments described herein generally relate to downhole tools. More particularly, such embodiments relate systems and methods for transmitting annulus pressure measurements from a downhole tool to a surface location.

BACKGROUND INFORMATION

Annulus pressure refers to the pressure of the fluid in an annulus between a drill string and the wellbore wall. Conventional managed pressure drilling ("MPD") technology controls the annulus pressure within tight predetermined pressure limits throughout the drilling process to avoid the loss of drilling fluid and the influx of formation fluid, as well as to maintain the stability of the wellbore. The pressure limits are defined by the formation pore pressure and the fracture pressure, which is sometimes as narrow as a few hundred pounds per square inch ("psi").

The MPD technology controls the annulus pressure-while-drilling ("APWD") by adjusting the back pressure and causing drilling to be either at balance or slightly over or under balance. Thus, as will be appreciated, the MPD technology may perform better when APWD data is received faster and/or more frequently. For example, the rapid transmission of APWD data may enable a user to predict a sudden pressure change during a drilling job with a narrow pressure window and to react accordingly.

The APWD is impacted by many factors including hydrostatic pressure, friction pressure, back pressure, mud rheological properties, flow rate, cutting movement, pipe movement, drill string configuration, fractures and washouts, drilling noise, mud pulsers, etc. The effects of these factors make the APWD data noisy and discontinuous. The APWD data typically has a data range from about 0 psi to about 30,000 psi. The data measurements may go up and down by about 50 psi within a few seconds or by several hundred psi within a minute.

The current speed for mud-pulse telemetry is a few (e.g., 5) bits per second. Transmitting the high sampling rate APWD data along with other drilling and formation evaluation data, therefore, may be challenging.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A method for transmitting data from a downhole tool to a surface location is disclosed. The method includes running a downhole tool into a wellbore. The downhole tool includes a pressure sensor. An annulus pressure in the wellbore is measured at a first time, using the pressure sensor, to produce a first pressure measurement. The first pressure measurement is compressed to produce a reference sample. The reference sample is transmitted to the surface location. The annulus pressure in the wellbore is measured at a second time, using the pressure sensor, to produce a second pressure measurement. A difference between the first pressure measurement and the second pressure measurement is determined to produce a first delta pressure measurement. The first delta pressure measurement is compressed to produce a first compressed delta pressure measurement. The first compressed delta pressure measurement is transmitted to the surface location.

In another embodiment, the method may include running a downhole tool into a wellbore. The downhole tool includes a pressure sensor. An annulus pressure in the wellbore is measured at a first time, using the pressure sensor, to produce a first pressure measurement. The first pressure measurement is confined to a first data range. The first pressure measurement is quantized. The annulus pressure in the wellbore is measured at a second time, using the pressure sensor, to produce a second pressure measurement. The second pressure measurement is confined to the first data range. The second pressure measurement is quantized. A difference between the first pressure measurement and the second pressure measurement is determined to produce a first delta pressure measurement. The first delta pressure measurement is confined to a second data range that is less than the first data range.

A method for decompressing data is also disclosed. The method may include receiving a first compressed pressure measurement. The first compressed pressure measurement is dequantized to produce a first uncompressed pressure measurement when the first compressed pressure measurement is less than or equal to a first predetermined number. A second compressed pressure measurement is received. A second predetermined number is subtracted from the second compressed pressure measurement to produce a first output when the second compressed pressure measurement is less than or equal to a third predetermined number. The first compressed pressure measurement is added to the first output to produce a second output. The second output is quantized to produce a second uncompressed pressure measurement.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings are illustrative embodiments, and are, therefore, not to be considered to limit the scope of the application.

DETAILED DESCRIPTION

Figure 1:
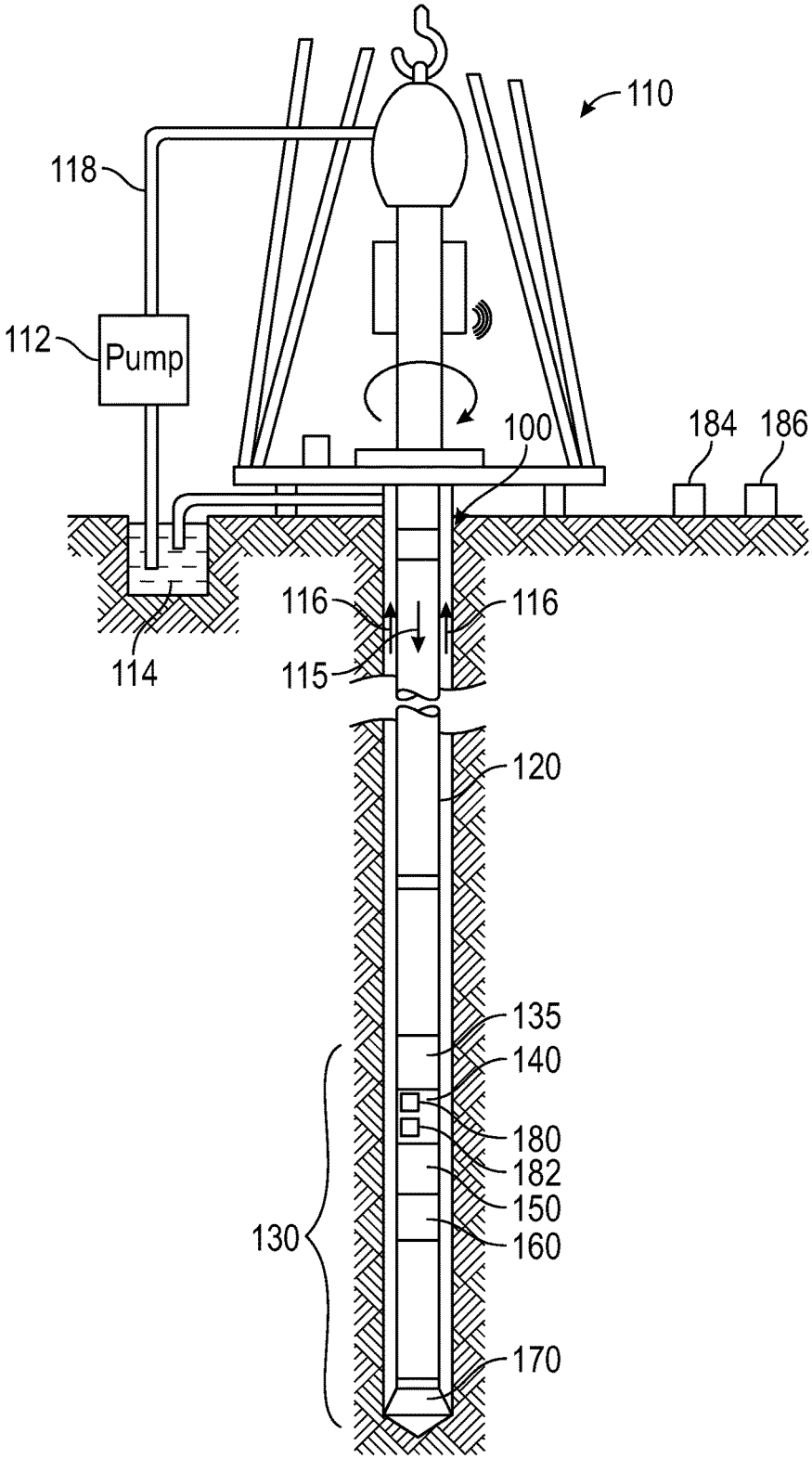
FIG. 1 depicts a cross-sectional view of an illustrative downhole tool in a wellbore, according to an embodiment.

FIG. 1 depicts a cross-sectional view of an illustrative downhole tool 130 in a wellbore 100, according to an embodiment. The downhole tool 130 may be run into the wellbore 100 on a drill string 120 that extends downward from a derrick assembly 110. The downhole tool 130 may be or include a bottom hole assembly ("BHA") that includes a telemetry module 135, a logging-while-drilling ("LWD") module 140, a measuring-while-drilling ("MWD") module 150, a mud motor 160, and drill bit 170.

The telemetry module 135 may be configured to transmit data from the downhole tool 130 to a receiver at the surface, as discussed in more detail below. For example, the telemetry module 135 may transmit data from the LWD module 140 and/or the MWD module 150 to the receiver at the surface using mud pulses. The LWD module 140 may be configured to measure one or more formation properties and wellbore physical properties as the wellbore 100 is being drilled or at any time thereafter. The MWD module 150 may be configured to measure one or more physical properties as the wellbore 100 is being drilled or at any time thereafter. The formation properties may include resistivity, density, porosity, sonic velocity, gamma rays, and the like. The physical properties may include pressure, temperature, wellbore caliper, wellbore trajectory, a weight-on-bit, torque-on-bit, vibration, shock, stick slip, and the like. For example, the physical properties may include the annular pressure-while-drilling ("APWD").

A pump 112 at the surface may cause a drilling fluid 114 to flow through the interior of the drill string 120, as indicated by the arrow 115. The drilling fluid 114 may flow through the mud motor 160, which may cause the mud motor 160 to drive the drill bit 170. After passing through the mud motor 160, the drilling fluid 114 may flow out of the drill bit 170 and then circulate upwardly through the annulus between the outer surface of the drill string 120 and the wall of the wellbore 100, as indicated by the directional arrows 116.

Figure 2:
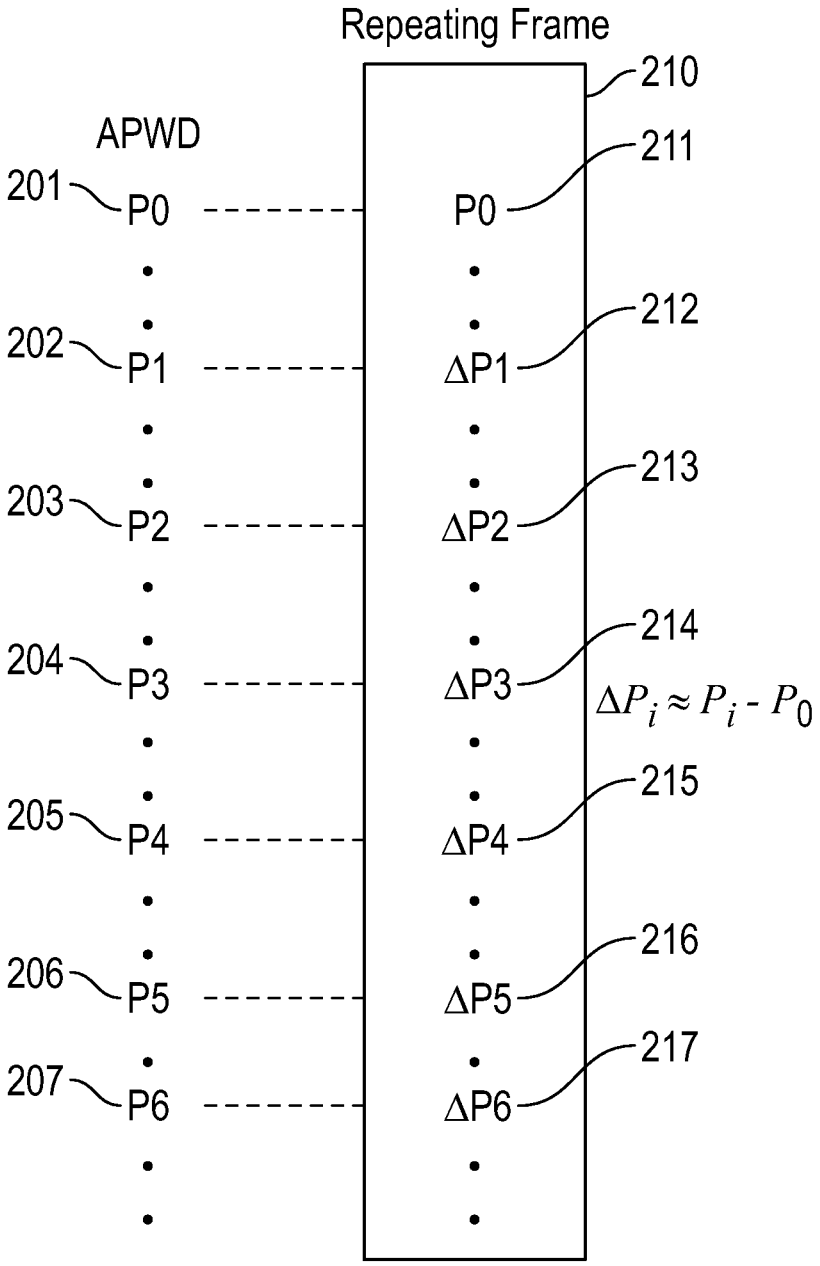
FIG. 2 depicts uncompressed APWD measurements in the left column and compressed APWD measurements in a repeating telemetry frame in the right column, according to an embodiment.

FIG. 2 depicts uncompressed APWD measurements 201-207 in the left column and compressed APWD measurements 211-217 in a repeating telemetry frame 210 in the right column, according to an embodiment. The LWD module 140 and/or the MWD module 150 may obtain a plurality of (uncompressed) APWD measurements (seven are shown: 201-207) when the downhole tool 130 is in the wellbore 100. The time spacing between each successive pair of APWD measurements (e.g., measurements 201, 202) may be from about 1 second to about 30 seconds, about 1 second to about 15 seconds, or about 1 second to about 5 seconds. The time spacing between successive measurements (e.g., measurements 201, 202) may be maintained evenly (e.g., within ±2 seconds) and close to the desired update rate.

A user may build the telemetry frame 210 starting by compressing the the first APWD measurement 201 to produce a reference sample 211. The reference sample 211 may be represented by, for example, 12 bits. The telemetry frame 210 may then include a series of delta pressure measurements 212-217 that each represents the difference between one of the subsequent APWD measurements 202-207 and the first APWD measurement 201. For example, the delta pressure measurement 212 may represent the difference between the second APWD measurement 202 and the first APWD measurement 201, the delta pressure measurement 213 may represent the difference between the third APWD measurement 203 and the first APWD measurement 201, and so on.

The delta pressure measurements 212-217 may include less data than their corresponding (e.g., uncompressed) APWD measurement 202-207. For example, the delta pressure measurements 212-217 may be represented by six bits. The delta pressure measurements 212-217 may be able to catch up a pressure variation up to a pre-defined limit for the time period during which the APWD measurements 201-207 are obtained. For example, the limit may be set to ±300 psi. When larger dynamic pressure ranges are expected, additional reference samples may be inserted into the telemetry frame 210 to shorten the time spacing between the delta pressure measurements 212-217 and the corresponding reference sample 211.

The delta pressure measurements (e.g., value 213) may be calculated from the reference APWD measurement 201, rather than from the previous APWD measurement (e.g., value 202), as the delta-modulation does, to avoid propagation errors from telemetry or from APWD measurements beyond the designed limit (e.g., ±300 psi). The compression of the APWD measurements 211-217 may be on-demand. For example, when a request of a pressure sample from the telemetry module 135 arrives, the compressor 182 (see FIG. 1) may locate the latest APWD measurement 201-207, apply compression, and return the result to the telemetry module 135.

Quantization and Encoding

Equation (1) may be used to quantize and encode the APWD measurements 201-207:

$$P_i=[p_i/q] \tag{1}$$

Where $p_i$ represents the pressure value of the ith sample, $P_i$ represents the corresponding quantized value, q represents the quantizer, and the square brackets [ ] represent the rounding operator. The quantizer q may be selected based on the desired accuracy. For example, selecting q=0.1 may yield a 10 psi resolution (e.g., ±5 psi quantization error).

The reference value 211 is denoted as $P_0$, and the delta pressure measurements 212-217 are denoted as $\Delta P_i$. Thus, Equation (2) may be:

$$\Delta P_i=P_i-P_0 \tag{2}$$

The reference value $P_0$ may be encoded with a 12-bit unsigned magnitude code. Thus, $P_0 \in [0, 4095]$. Choosing quantizer q=0.1, the quantization and coding scheme may allow $p_0 \in [0, 40930]$ psi, as the values $P_0$=4094 and 4095 may be used for exception handling. A reference pressure value outside the range may be truncated at the boundary limits.

The delta-values $\Delta P_i$ may be encoded with 6-bit signed magnitude codes. Choosing quantizer q=0.1, $\Delta P_i$ may be confined within the range [−31, 30], corresponding to pressure differences within [−310, 300] psi from the reference value. A pressure difference outside the range may be truncated at the limits. During coding, $\Delta P_i$ may be further shifted to an unsigned representation by Equation (3):

$$\Delta P_i=\Delta P_i+31 \tag{3}$$

which makes $\Delta P_i$ fall in the range of 0~61. Knowing that 6-bits may represent values of [0, 63], the values $\Delta P_i$=62 and 63 may again be used for exception handling.

Exception Handling

There may be cases of exceptions including (1) inaccurate APWD measurements 201-207 from the pressure gauge in the LWD module 140 and/or MWD module 150, and/or (2) a communication error between the LWD module 140 and/or MWD module 150 and the telemetry module 135.

The two scenarios may occur on both the reference sample 211 and the delta pressure measurements 212-217. When an exception occurs to the reference sample 211, both the reference sample 211 and the corresponding delta pressure measurements 212-217 may be discarded at the decompression end. When an exception occurs to one of the compressed delta values (e.g., value 213), the single APWD measurement (e.g., value 203), corresponding to the delta pressure measurement 213, may be discarded. In the example shown in Table 1 example, the following values may be designated to indicate the above exceptions:

TABLE 1

| | Reference | Delta Pressure Measurement |
|---|---|---|
| Communication Error | 4095 | 63 |
| Bad Pressure Reading | 4094 | 62 |

Update Rate vs Bandwidth Consumption

The bandwidth usage for the transmission of the delta pressure measurements 212-217 may at least partially depend upon the desired sample update rate. The bandwidth usage may also be slightly affected by the repeating frame 210. Equation (4) illustrates the relation between the bandwidth usage and the repeating frame 210:

$$B = \frac{12 \times 6 \times [\text{floor}(T_f / \Delta t) - 1]}{T_f} \quad (4)$$

where B represents the bandwidth usage in bits-per-second, Δt represents the sample update spacing in seconds, and $T_f$ represents the repeating frame time in seconds.

Figure 3:
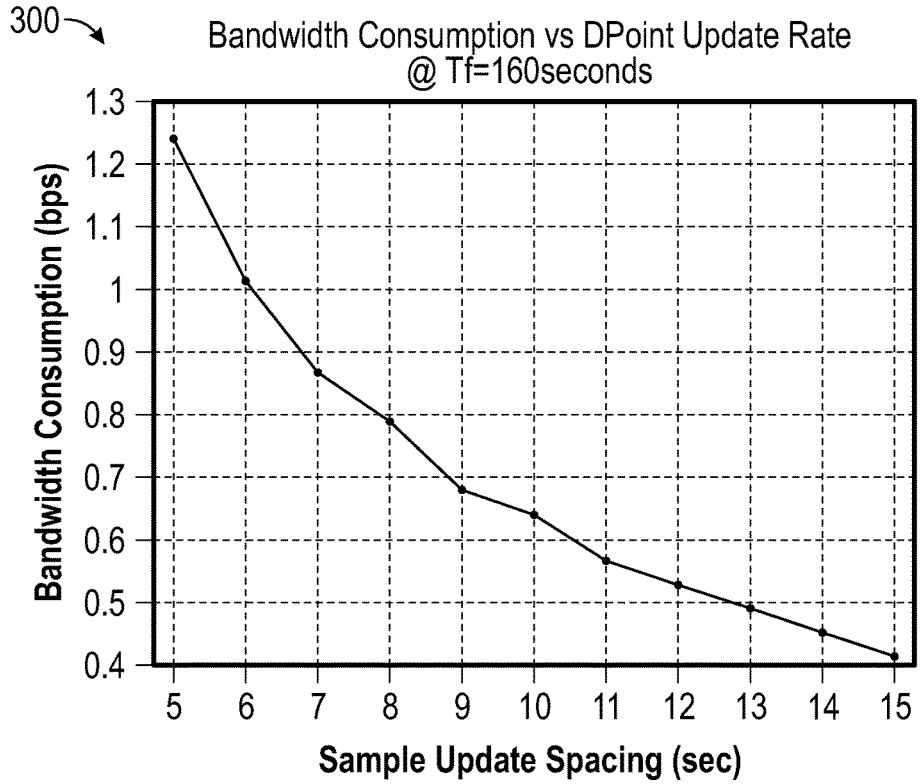
FIG. 3 depicts a graph showing the relation between the bandwidth consumption and the update spacing of the APWD measurements, according to an embodiment.

FIG. 3 depicts a graph 300 showing the relation between the bandwidth consumption and the sample update spacing, according to an embodiment. To obtain a pressure sample at, for example, every six to 10 seconds, bandwidths from 1.0 bps down to 0.6 bps may be used. This indicates that sending the high sampling rate APWD measurements 201-207 may be achievable under the typical mud pulse telemetry running at a 3-6 bps data rate.

Error Rate

Figure 4:
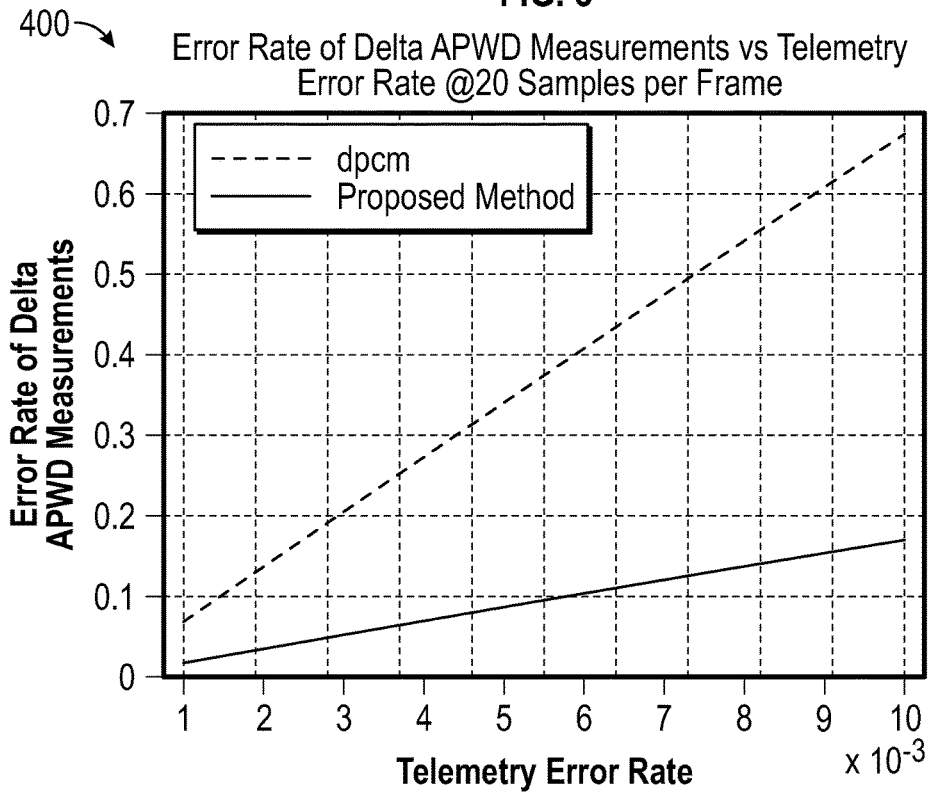
FIG. 4 depicts a graph showing the difference of the error corruption rates between the proposed method and the DPCM method, according to an embodiment.

As mentioned the above, the proposed method of differential encoding may reduce error propagation compared to the conventional differential pulse code modulation ("DPCM") or delta modulation methods. FIG. 4 depicts a graph 400 showing the difference of the error corruption rates between the proposed method and the DPCM method, according to an embodiment. The example shown in FIG. 4 corresponds to a telemetry frame that contains 20 samples of delta pressure measurements with one reference value at the beginning. The X-axis may be the telemetry error rate ranging from one-per-thousand to one percent. The Y-axis may be the error rate of delta pressure measurements (i.e., the fractions of the delta pressure measurements being corrupted due to telemetry corruptions). As may been seen, at the typical telemetry error rate of three-per-thousand, the delta pressure measurement error rate of the proposed method is about 5%, compared to 21% given by the DPCM method. Even under noisy telemetry conditions with a 1% error rate, the measurements transmitted by the proposed method still provide an update rate that drops about ⅙ of the corrupted samples, while the DPCM method yields about ⅔ of the corrupted samples.

Figure 5:
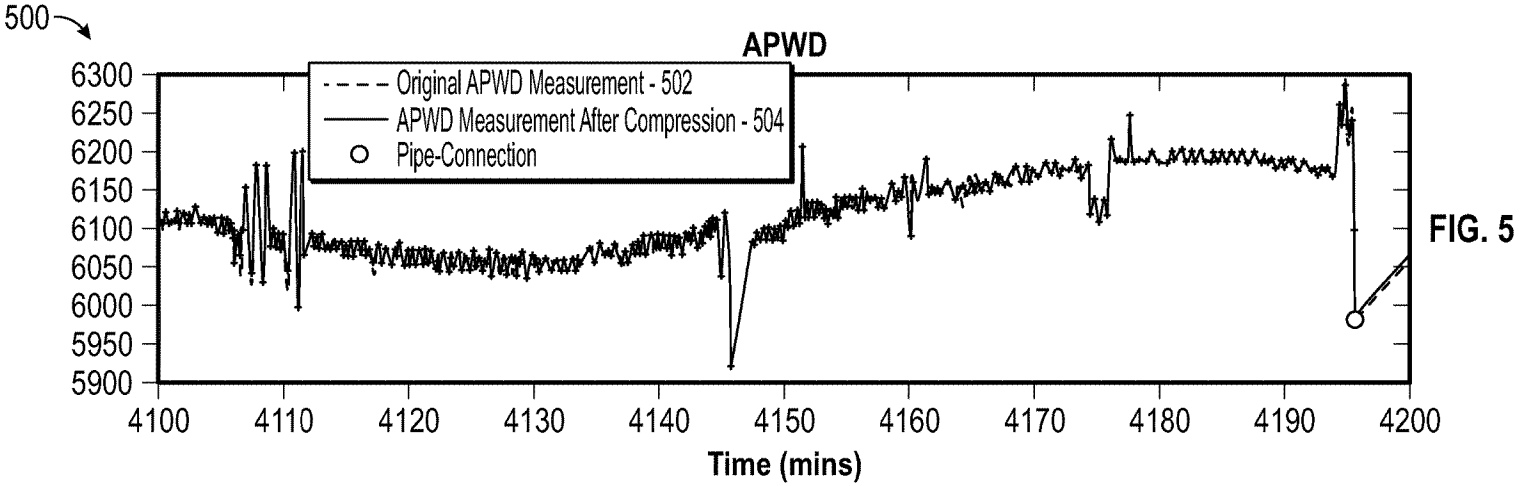
FIGS. 5 and 6 depict graphs showing two cases of APWD measurements retrieved from compressed transmission, according to an embodiment.
Figure 6:
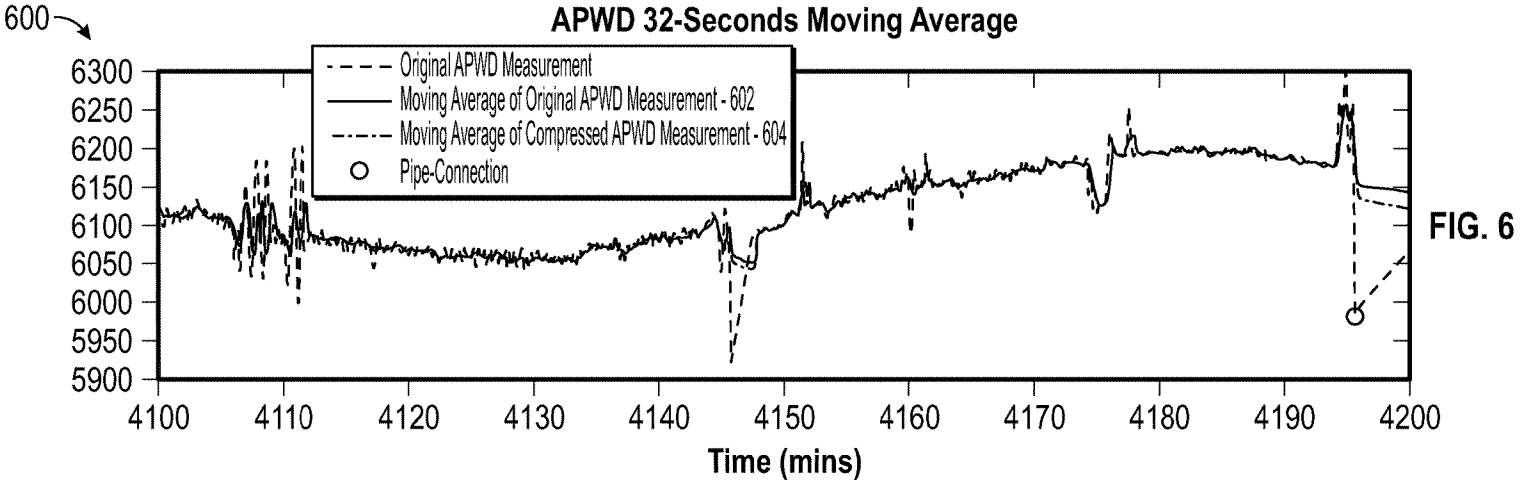

FIGS. 5 and 6 depict graphs 500, 600, respectively, showing two cases of APWD measurements retrieved from compressed transmission, according to an embodiment. The first graph 500 shows the comparison between the original APWD measurements sampled at a two-second rate before compression 502 and the surface received data after compression 504 sampled at an eight-second rate. The second graph 600 shows the moving averages of 32-second windows from the original data 602 and from the compressed data 604. As may be seen, the curves before and after compression match very well, even in the area where the data is very noisy and presents dynamic ranges more than 200 psi within about 20 second time intervals.

Figure 7:
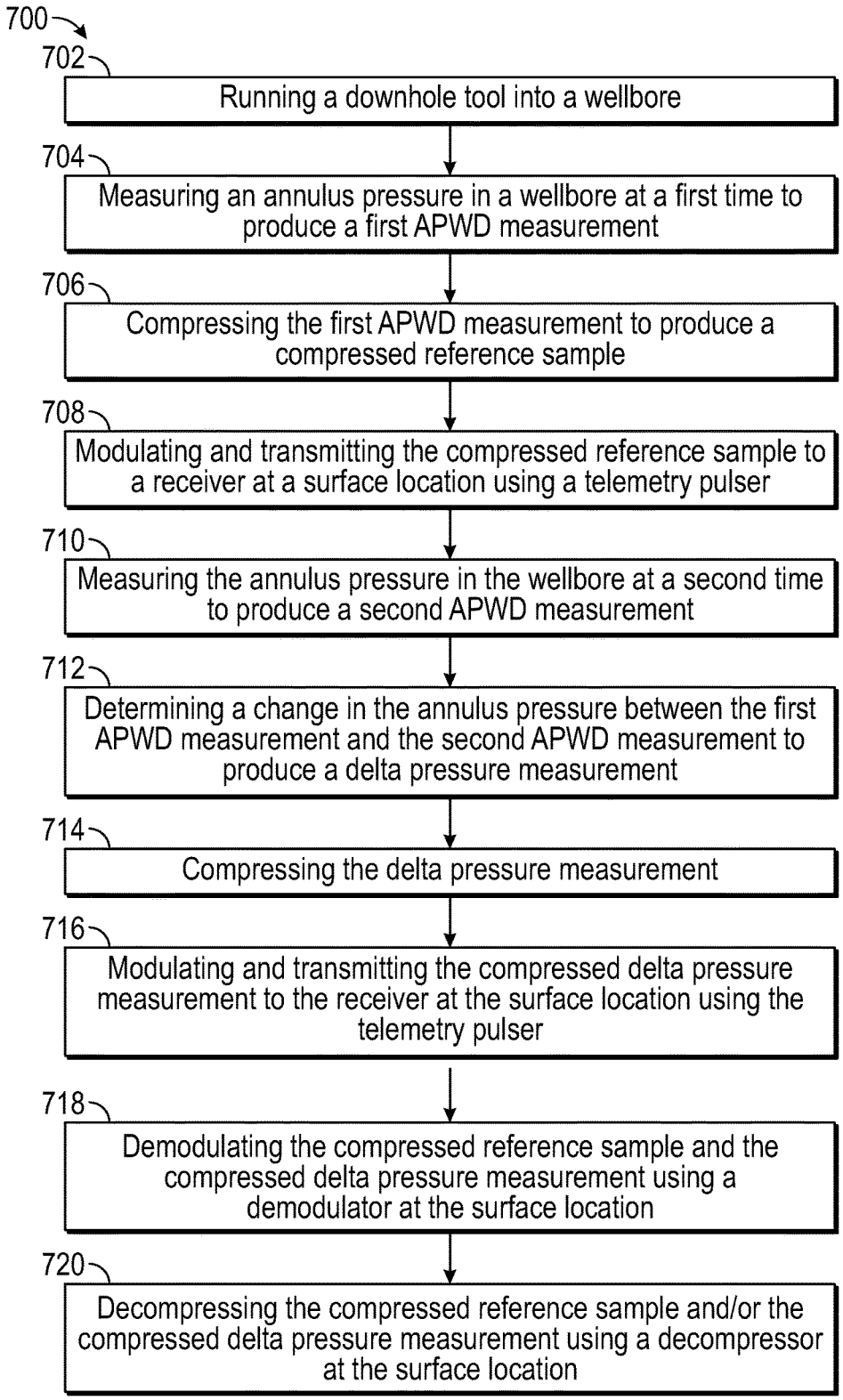
FIG. 7 depicts a flowchart of a method for transmitting APWD measurements from a downhole tool to a surface location, according to an embodiment.

FIG. 7 depicts a flowchart of a method 700 for transmitting APWD measurements 201-207 from a downhole tool 130 to a surface location, according to an embodiment. Although the method 700 is described with reference to APWD measurements 201-207, it will be appreciated that the method 700 may also be applied to other types of measurements obtained by the LWD tool 140 or the MWD tool 150.

The method 700 may begin by running the downhole tool 130 into the wellbore 100, as at 702. The method 700 may also include measuring the annulus pressure in the wellbore 100 at a first time to produce a first APWD measurement 201, as at 704. The annulus pressure may be measured with a pressure sensor 180 that is part of the downhole tool 130. More particularly, the pressure sensor 180 may be part of the LWD tool 140 or the MWD tool 150. The method 700 may then include compressing the first APWD measurement 201 to produce a compressed reference sample 211, as at 706. The compression device 182 (see FIG. 1) may be positioned within the LWD tool 140 or the MWD tool 150 that obtains the APWD measurement 201. The method 700 may then include modulating and transmitting the compressed reference sample 211 to a receiver at the surface location using the telemetry pulser 135, as at 708.

The method 700 may then include measuring the annulus pressure in the wellbore at a second time to produce a second APWD measurement 202, as at 710. The method 700 may then include determining a change in the annulus pressure between the first APWD measurement 201 and the second APWD measurement 202 to produce a first delta pressure measurement 212, as at 712. The method 700 may then include compressing the first delta pressure measurement 212, as at 714. The method 700 may then include modulating and transmitting the first delta pressure measurement 212 to the receiver at the surface location using the telemetry pulser 135, as at 716.

The method 700 may also include demodulating the compressed reference sample 211 and the first delta pressure measurement 212 using a demodulator 184 at the surface location, as at 718. The method 700 may then include decompressing the compressed reference sample 211 and/or the first delta pressure measurement 212 using a decompressor 186 at the surface location, as at 720. In response to receiving the compressed reference sample 211 and the first delta pressure measurement 212, a user may reduce the weight of the mud that is being pumped into the wellbore from the surface, vary the flow rate of the mud that is being pumped into the wellbore from the surface, vary the weight on the drill bit, or a combination thereof.

If the (now uncompressed) delta pressure measurement is outside a predetermined range, a user may understand that the corresponding APWD measurements (201-207) are beyond the compressible data range of [−310, 300] from the reference sample (200) and determine whether the out or range APWD measurements may have gone beyond the pressure limits allowed by the designed MPD task.

The method 700 may be repeated for additional APWD measurements (e.g., value 203). Subsequent delta pressure measurements (e.g., value 213) may be produced by determining a change in the annulus pressure between the first APWD measurement 201 and the third APWD measurement 203 to produce a second delta pressure measurement 213. The method 700 may then include compressing the second delta pressure measurement 213. The method 700 may then include modulating and transmitting the second delta pressure measurement 213 to the receiver at the surface location using the telemetry pulser 135.

Figure 8:
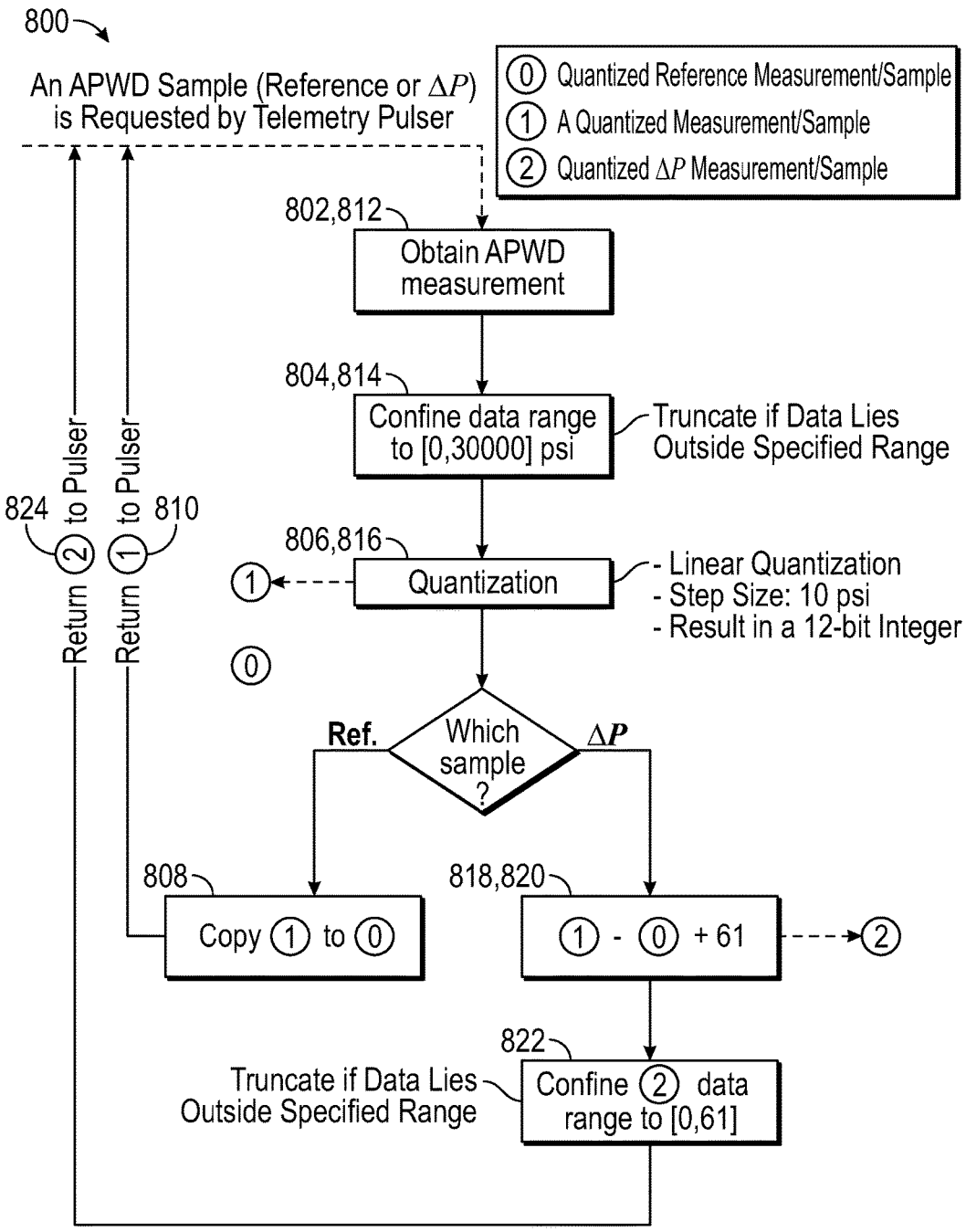
FIG. 8 depicts a flow chart of a method for compressing the APWD measurements, according to an embodiment.

FIG. 8 depicts a flow chart of a method 800 for compressing the APWD measurements 201-207, according to an embodiment. The method 800 may include obtaining a first APWD measurement (e.g., value 201) using the pressure sensor 180 in the downhole tool 130, as at 802. The first APWD measurement 201 may be obtained in response to a request from the telemetry pulser 135 in the downhole tool 130. The method 800 may then include compressing or confining the first APWD measurement 201 to a predetermined data range, as at 804. The compression/confinement may be performed within the downhole tool 130 (e.g., within the compression device 182 in the downhole tool 130). The predetermined data range may be, for example, [0, 30000] psi. Data outside the predetermined range may be truncated.

The method 800 may also include quantizing the first APWD measurement 201, as at 806. The quantization may be performed within the downhole tool 130 (e.g., within the compression device 182 in the downhole tool 130). The quantization may be a linear quantization. The step size of the quantization may be from about 1 psi to about 100 psi or from about 2 psi to about 20 psi. For example, the step size may be about 10 psi. After the quantization, the first APWD measurement 201 may be represented by an integer including a plurality of bits. The number of bits may be from about 6 bits to about 18 bits or from about 8 bits to about 16 bits. For example, the first APWD measurement 201 may be represented by a 12-bit integer. Thus, the first APWD measurement may now be the reference sample 211.

If the first APWD measurement 211 is to be used as the reference sample, then the method 800 may include copying or storing the first APWD measurement 211 into a reference sample location in the downhole tool 130 (e.g., a particular memory location), as at 808. The method 800 may then include transmitting the first APWD measurement 211 to the telemetry pulser 135 in the downhole tool 130, as at 810.

The method 800 may also include obtaining a second APWD measurement 202 using the pressure sensor 180 in the downhole tool 130, as at 812. The second APWD measurement 202 may be obtained in response to another request from the telemetry pulser 135 in the downhole tool 130. The method 800 may then include compressing or confining the second APWD measurement 202 to the predetermined data range, as at 814. The predetermined data range may be the same as above, for example, [0, 30000] psi. Data outside the predetermined range may be truncated.

The method 800 may also include quantizing the second APWD measurement 202, as at 816. The quantization may be performed within the downhole tool 130 (e.g., within the compression device 182 in the downhole tool 130). The quantization may be a linear quantization. The step size of the quantization may be from about 1 psi to about 100 psi or from about 2 psi to about 20 psi. For example, the step size may be about 10 psi. After the quantization, the second APWD measurement 202 may be represented by an integer including a plurality of bits. The number of bits may be from about 6 bits to about 18 bits or from about 8 bits to about 16 bits. For example, the second APWD measurement 202 may be represented by a 12-bit integer.

If the second APWD measurement 202 is to be used to determine one of the delta pressure measurements (e.g., value 212), then the method 800 may include determining the difference between the second APWD measurement 202 and the first APWD measurement 201, as at 818. As this value may be negative in some embodiments, the method 800 may also include adding a predetermined number to the difference between the second APWD measurement 202 and the first APWD measurement 201 to produce a positive output value, as at 820. The predetermined number may be from about 1 to about 63 (or more). For example, the predetermined number may be 61 corresponding to a 6 bit number (0-63), where 62 and 63 have been assigned already.

The method 800 may then include compressing or confining the positive output to a predetermined data range, as at 822. The predetermined data range may be, for example, [0, 61]. Data outside the predetermined range may be truncated. The method 800 may then include transmitting the positive output (corresponding to the difference between the second APWD measurement 202 and the first APWD measurement 201) to the telemetry pulser 135 in the downhole tool 130, as at 824.

Figure 9:
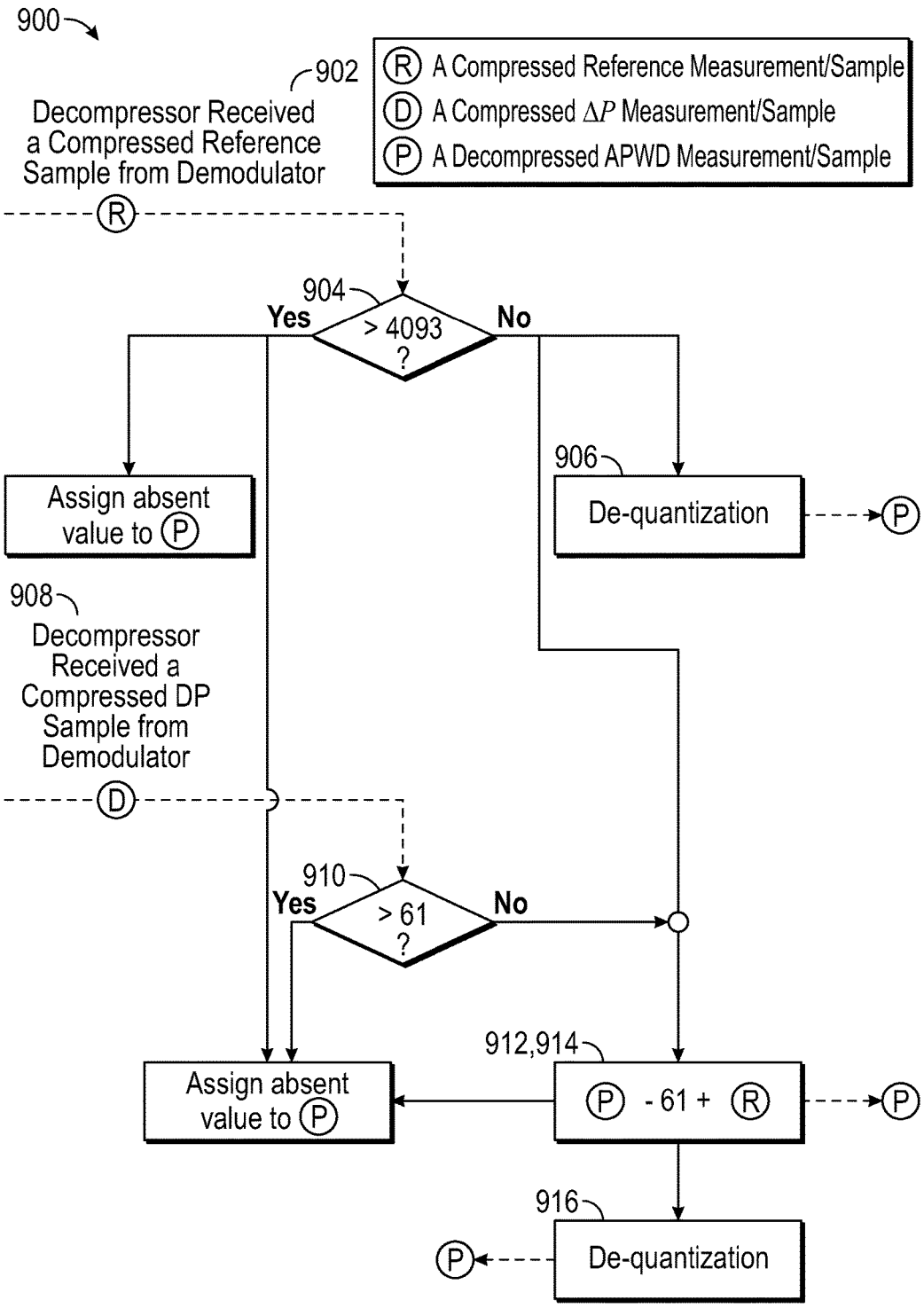
FIG. 9 depicts a flow chart of a method for decompressing the APWD measurements, according to an embodiment.

FIG. 9 depicts a flow chart of a method 900 for decompressing the APWD measurements 211-217, according to an embodiment. The method 900 may begin by receiving a first compressed APWD measurement 211-217, as at 902. The first compressed APWD measurement 211-217 may be received by a decompressor 186 at a surface location. Prior to being received by the decompressor 186, the compressed APWD measurement 211-217 may be transmitted from the downhole tool 130 (in the wellbore 100) to a demodulator 184 at the surface location, and the demodulator 184 may demodulate the compressed first APWD measurement 211-217 before sending the compressed first APWD measurement 211-217 to the decompressor 186.

If the first compressed APWD measurement 211-217 is 12 bits, this may indicate that the first compressed APWD measurement 211-217 represents the reference sample (e.g., value 211). The method 900 may then include determining whether the first compressed APWD measurement 211 is greater than a first predetermined number, as at 904. The first predetermined number may be from about 1 to about 4095 (or more). For example, the first predetermined number may be 4093 corresponding to a 12-bit number (0-4095), where 4094 and 4095 have been assigned already.

If the first compressed APWD measurement 211 is greater than the first predetermined number, an absent value may be assigned to the APWD measurement (e.g., value 201) corresponding to the first compressed APWD measurement 211, indicating that the APWD measurement 201 is invalid. The APWD measurement 201 may be invalid for any of the reasons described above. If the first compressed APWD measurement 211 is less than the predetermined number, the first compressed APWD measurement 211 may be dequantized to produce a decompressed APWD measurement, as at 906.

The method 900 may also include receiving a second compressed APWD measurement 211-217, as at 908. If the second compressed APWD measurement 211-217 is 6 bits, this may indicate that the second compressed APWD measurement 211-217 represents one of the delta pressure measurements (e.g., value 212). The method 900 may then include determining whether the second compressed APWD measurement 212 is greater than a second predetermined number, as at 910. The second predetermined number may be from about 1 to about 63 (or more). For example, the second predetermined number may be 61 corresponding to a 6 bit number (0-63), where 62 and 63 have been assigned already.

If the second compressed APWD measurement 212 is greater than the second predetermined number, an absent value may be assigned to the APWD measurement (e.g., value 202) corresponding to the second compressed APWD measurement 212, indicating that the APWD measurement 202 is invalid. If the second compressed APWD measurement 212 is less than the second predetermined number, the second predetermined number may be subtracted from the second compressed APWD measurement 212 to produce a first output, as at 912.

The first compressed APWD measurement 211 may be added to the first output to produce a second output, as at 914. The second output may then be de-quantized to produce a decompressed APWD measurement (e.g., the APWD measurement 202), as at 916.

The methods 700, 800, 900 disclosed herein allow transmitting the real-time APWD measurements at high sampling rates at an affordable cost of bandwidth under the normal MWD mud-pulse telemetry environment. The APWD measurements may be sent to the surface at any user desired update rates. Transmission at a 6-second update rate may cost about 1.0 bps bandwidth, and a 10-second update rate may cost about 0.64 bps. The methods 700, 800, 900 may also support a pressure range of 0-40 kpsi while providing a resolution of ±5 psi. The methods 700, 800, 900 may allow a pressure variation of ±300 psi within the time period of the telemetry frame 210, (e.g., from 80 seconds to 200 seconds). A measurement with a pressure reading exceeding the specified data range may be truncated without affecting the subsequent measurements. The methods 700, 800, 900 may also allow the user to insert more reference samples in the telemetry frame to reduce the probability of pressure readings going beyond defined dynamic data range. The methods 700, 800, 900 may effectively avoid error propagation that presents under the standard DPCM compression schemes. Under typical mud-pulse telemetry error rate (e.g., three-per-thousand), the received sample corruption rate may be as low as 5%. The methods 700, 800, 900 do not introduce any additional transmission delay due to compression and, thus, make it possible for drilling operators to predict and to react promptly to a quick pressure change.

Figure 10:
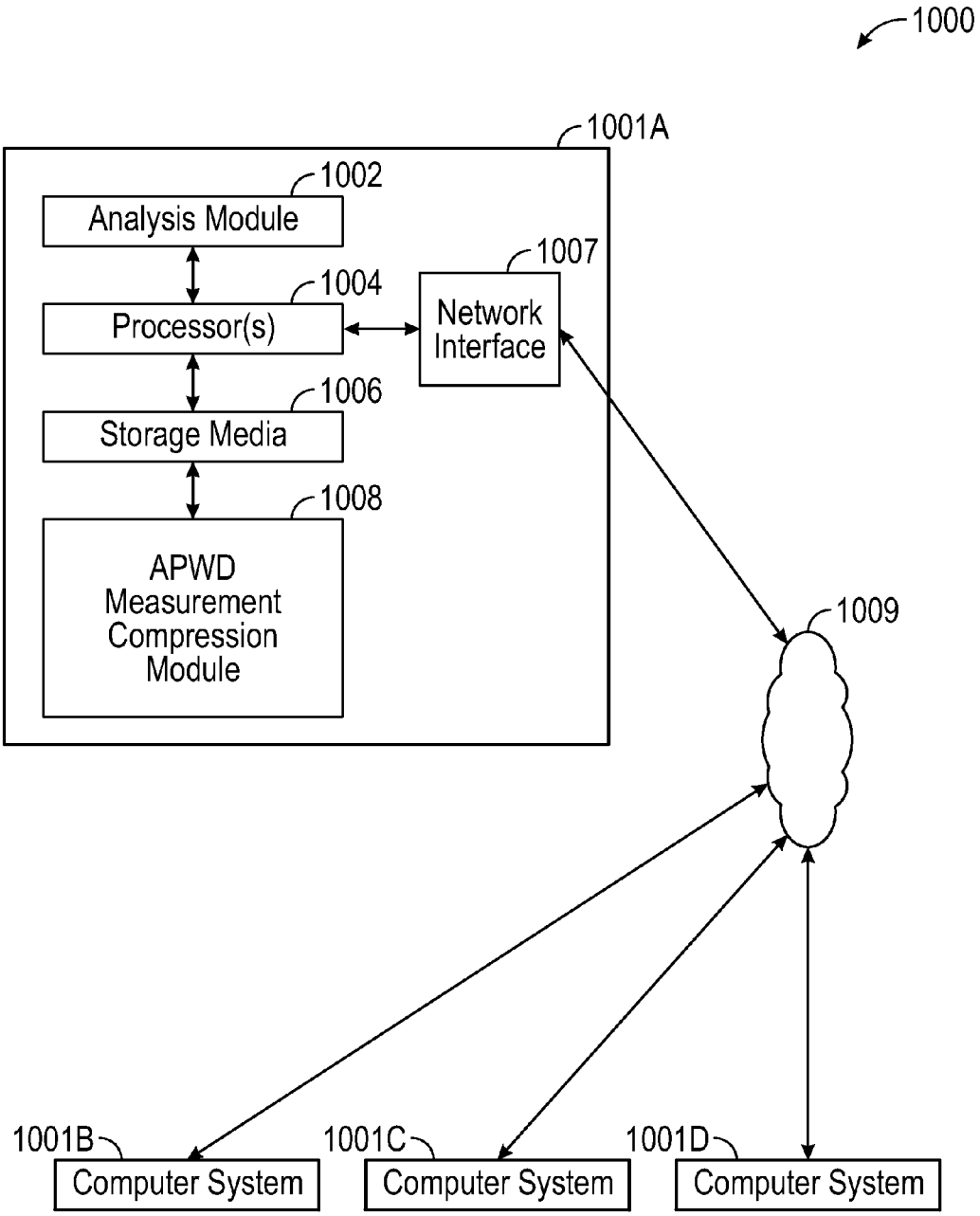
FIG. 10 depicts a computing system for performing one or more of the methods disclosed herein, according to an embodiment.

FIG. 10 depicts a computing system 1000 for performing the methods 700, 800, 900, according to an embodiment. The computing system 1000 may include a computer or computer system 1001A, which may be an individual computer system 1001A or an arrangement of distributed computer systems. The computer system 1001A may be at least partially disposed within the downhole tool 130. The computer system 1001A includes one or more analysis modules 1002 that are configured to perform various tasks according to some embodiments, such as one or more methods disclosed herein. To perform these various tasks, the analysis module 1002 executes independently, or in coordination with, one or more processors 1004, which is (or are) connected to one or more storage media 1006A. The processor(s) 1004 is (or are) also connected to a network interface 1007 to allow the computer system 1001A to communicate over a data network 1009 with one or more additional computer systems and/or computing systems, such as 1001B, 1001C, and/or 1001D (note that computer systems 1001B, 1001C and/or 1001D may or may not share the same architecture as computer system 1001A, and may be located in different physical locations, e.g., computer systems 1001A and 1001B may be located in a processing facility, while in communication with one or more computer systems such as 1001C and/or 1001D that are located in one or more data centers, and/or located in varying countries on different continents).

A processor can include a microprocessor, microcontroller, processor module or subsystem, programmable integrated circuit, programmable gate array, or another control or computing device.

The storage media 1006A can be implemented as one or more computer-readable or machine-readable storage media. Note that while in the example embodiment of FIG. 10 storage media 1006A is depicted as within computer system 1001A, in some embodiments, storage media 1006A may be distributed within and/or across multiple internal and/or external enclosures of computing system 1001A and/or additional computing systems. Storage media 1006A may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURRY® disks, or other types of optical storage, or other types of storage devices. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

In some embodiments, computing system 1000 contains one or more APWD compression module(s) 1008. The APWD compression module 1008 may be configured to compress the APWD measurements 201-207 prior to transmitting the measurements to the surface location.

It should be appreciated that computing system 1000 is only one example of a computing system, and that computing system 1000 may have more or fewer components than shown, may combine additional components not depicted in the example embodiment of FIG. 10, and/or computing system 1000 may have a different configuration or arrangement of the components depicted in FIG. 10. The various components shown in FIG. 10 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Although the preceding description has been described herein with reference to particular means, materials, and embodiments, it is not intended to be limited to the particulars disclosed herein; rather, it extends to all functionally equivalent structures, methods, and uses, such as are contemplated within the scope of the appended claims. While the foregoing is directed to embodiments of the present invention, other and further embodiments of the invention may be devised without departing from the basic scope thereof.

What is claimed is:

1. A method for transmitting data from a downhole tool to a surface location, comprising:

running a downhole tool into a wellbore, wherein the downhole tool comprises a pressure sensor;

measuring an annulus pressure in the wellbore at a first time, using the pressure sensor, to produce a first pressure measurement;

compressing the first pressure measurement to produce a reference sample;

transmitting the reference sample to the surface location;

measuring the annulus pressure in the wellbore at a second time, using the pressure sensor, to produce a second pressure measurement;

determining a difference between the first pressure measurement and the second pressure measurement to produce a first delta pressure measurement;

compressing the first delta pressure measurement to produce a first compressed delta pressure measurement; and transmitting the first compressed delta pressure measurement to the surface location.

2. The method of claim 1, further comprising:

measuring the annulus pressure in the wellbore at a third time, using the pressure sensor, to produce a third pressure measurement;

determining a difference between the first pressure measurement and the third pressure measurement to produce a second delta pressure measurement;

compressing the second delta pressure measurement to produce a second compressed delta pressure measurement; and transmitting the second compressed delta pressure measurement to the surface location.

3. The method of claim 1, further comprising:

demodulating the reference sample and the first compressed delta pressure measurement at the surface location; and decompressing the reference sample and the first compressed delta pressure measurement at the surface location.

4. The method of claim 1, wherein the reference sample and the first compressed delta pressure measurement are transmitted using mud pulses.

5. The method of claim 1, wherein the reference sample is represented using more bits than the first compressed delta pressure measurement.

6. The method of claim 1, wherein compressing the first pressure measurement to produce the reference sample comprises confining the first pressure measurement to a predetermined data range.

7. The method of claim 6, wherein confining the first pressure measurement to the predetermined data range comprises truncating a portion of the first pressure measurement that is outside the predetermined data range.

8. The method of claim 6, wherein compressing the first pressure measurement to produce the reference sample further comprises quantizing the first pressure measurement.

9. The method of claim 8, wherein quantizing the first pressure measurement comprises:

selecting a step size corresponding to a predetermined pressure range; and producing an integer having a predetermined number of bits.

10. The method of claim 1, further comprising varying a weight of a drilling mud that is pumped into the wellbore from the surface location or varying a rate that the drilling mud is pumped into the wellbore from the surface location in response to transmitting the first compressed delta pressure measurement to the surface location.

* * * * *